US005199856A

United States Patent [19]

Epstein et al.

[11] Patent Number: 5,199,856

[45] Date of Patent: Apr. 6, 1993

[54] PASSIVE STRUCTURAL AND AERODYNAMIC CONTROL OF COMPRESSOR SURGE

[75] Inventors: Alan H. Epstein, Lexington; Edward M. Greitzer, Wayland; Daniel L. Gysling, West Newton; John Dugundji, Belmont; Gerald R. Guenette, Salem, all of Mass.

[73] Assignee: Massachusetts Institute of Technology, Cambridge, Mass.

[21] Appl. No.: 317,441

[22] Filed: Mar. 1, 1989

[51] Int. Cl.[5] ..... F04B 11/00

[52] U.S. Cl. ..... 417/312; 417/540; 417/542; 137/568

[58] Field of Search ..... 417/540, 542, 312; 137/568

[56] References Cited

U.S. PATENT DOCUMENTS

| | | | |
|---|---|---|---|
| 1,846,483 | 2/1932 | Gilbert | 417/540 X |
| 2,198,021 | 4/1940 | Wood | 417/312 X |
| 2,316,278 | 4/1943 | Orsmansky, Jr. | 417/540 X |
| 3,487,855 | 1/1970 | Lautenberger, Jr. | 137/568 X |
| 4,177,649 | 12/1979 | Venema . | |
| 4,309,871 | 1/1982 | Venema . | |
| 4,449,358 | 5/1984 | Mani . | |
| 4,504,188 | 3/1985 | Traver et al. . | |

FOREIGN PATENT DOCUMENTS

| | | | |
|---|---|---|---|
| 891635 | 3/1962 | United Kingdom | 417/540 |

OTHER PUBLICATIONS

Bodine, A. G., "Sonic Control of Dynamic Compressor Instability", Symposium on Compressor Stall, Surge and System Response, 21-22 (May 1960).

Epstein, A. H., "Active Suppression of Compressor Instabilities", AIAA 10th Aeroacoustics Conference (Jul. 9-11, 1986).

Epstein, A. H., "Smart engine components: A micro inevery blade?", Aerospace America, 60-64 (Jan. 1986).

Venema, H. J., "Surge Suppression in an Inverter Driver Motor Compressor System", no date (not published).

*Primary Examiner*—Arnold Rosenthal

*Attorney, Agent, or Firm*—Choate, Hall & Stewart

[57] ABSTRACT

A compressor or pump is connected to a discharge plenum. The plenum includes a movable wall whose motion varies the volume of the plenum. The wall is connected to passive elements forming a spring-mass-damper system whose characteristics are selected to damp pressure fluctuations in the plenum which would give rise to pumping system instabilities. In another aspect of the invention, a compressor is connected to a discharge plenum which in turn is connected to an exit throttle. The throttle includes a movable portion whose motion varies the throttle area. The movable portion is connected to passive elements forming a spring-mass-damper system selected to damp pressure fluctuations in the plenum. In another embodiment, the plenum communicates with a fixed area throttle and a variable area throttle. The variable area throttle includes a movable portion connected to passive elements selected to damp pressure fluctuations in the plenum. Aerodynamic surge control is effected by coupling a second Helmholtz resonator to the plenum.

2 Claims, 9 Drawing Sheets

PASSIVE STRUCTURAL AND AERODYNAMIC CONTROL OF COMPRESSOR SURGE

The Government has rights to this invention pursuant to Air Force Office of Scientific Research Grant No. AFOSR-87-0398.

BACKGROUND OF THE INVENTION

This invention relates to passive structural and aerodynamic control of compressor surge.

When connected to discharge ducting, piping, and volumes, substantially all fluid compressors and pumps can generate pressure oscillations due to instabilities of the pumping system known as surge and stall. The amplitude of these oscillations may be small or large compared to the mean pressure rise in the compressor but, in either case, operation under these conditions is not acceptable due to increased pumping losses and, even more importantly, serious mechanical damage which may accrue. Surge occurs near the maximum pressure the compressor can deliver and thus is often a strict limit to compressor performance. These instabilities are serious problems in such diverse applications as jet engine compressors, automotive turbochargers, gas pipelines, and chemical process plants. Suppression of these instabilities is extremely important because they stand as limits to the performance of all turbomachine pumping systems. Increased stability can be directly translated into a large increase in machine performance—operating range and pressure rise—for essentially any compressor or pump to which it might be applied.

Because of its importance, the control of surge and stall has been explored over the past twenty years. The aim of past research was to realize an increase in average performance by reducing the steady state surge margin, detecting the onset of rotating stall or surge, and then backing off the compressor operating point (lowering its pressure rise) when required, thus trading performance for stability. The approach taken was largely empirical and did not prove totally successful, mainly due to problems associated with detection of the onset of the instability and with the necessity for large control forces required to move the compressor operating point. Active suppression of compressor instabilities has also been proposed. See, "Active Suppression of Compressor Instabilities" AIAA 10th Aerocoustics Conference, Jul. 9-11, 1986, Seattle, Wash. This paper discussed active control of a moving plenum wall to damp surge and suggested, without analysis, that the motions of the plenum wall could be driven by fluctuations in plenum pressure rather than by an active external control. The present invention is directed at suppressing surge in compressor pumping systems using structural and fluid dynamic feedback.

SUMMARY OF THE INVENTION

In one aspect of the invention, a compressor is connected to a discharge plenum which includes a movable wall whose motion varies the volume of the plenum. The wall is connected to passive elements modeled as a spring-mass-damper system selected to damp pressure fluctions in the plenum so as to control surge. In one embodiment, a rigid piston and aerodynamic spring are used. Damping is provided by a hydraulic actuator modified by connecting the ports to an adjustable throttling valve thereby yielding an adjustable, guasi-viscous dashpot.

In another aspect of the invention, the plenum is connected to an exit throttle which includes a movable portion whose motion varies the throttle area. The movable portion of the throttle is connected to passive elements forming a spring-mass-damper system selected to damp pressure fluctuations in the plenum. In yet another aspect of the invention, the plenum communicates with a first, fixed area throttle and a second, variable area throttle. The variable area throttle includes a movable portion connected to passive elements forming a spring-mass-damper system selected to damp pressure fluctuations in the plenum.

In yet another aspect of the invention, a second Helmholtz resonator system is added in series to the original system. The two systems are connected by a low pressure loss throttle. When properly tuned, the second resonator system damps pressure oscillations in the main plenum by mass flow oscillations between the two volumes through the low pressure drop throttle. This aerodynamic damper is the fluid dynamic version of the flexible plenum wall embodiment.

DESCRIPTION OF THE PREFERRED EMBODIMENT

The range of operation of modern turbomachinery is often limited by the onset of fluid dynamic instabilities. The instabilities can be classified into two major categories: surge and rotating stall. Surge, with which the present invention is concerned, is essentially a one-dimensional system instability characterized by violent oscillations in mass flow through the machine. Rotating stall is a two-dimensional instability in which a region of stalled flow rotates around the compressor annulus. Rotating stall is characterized by reduced mass flow and pressure rise.

Figure 1:
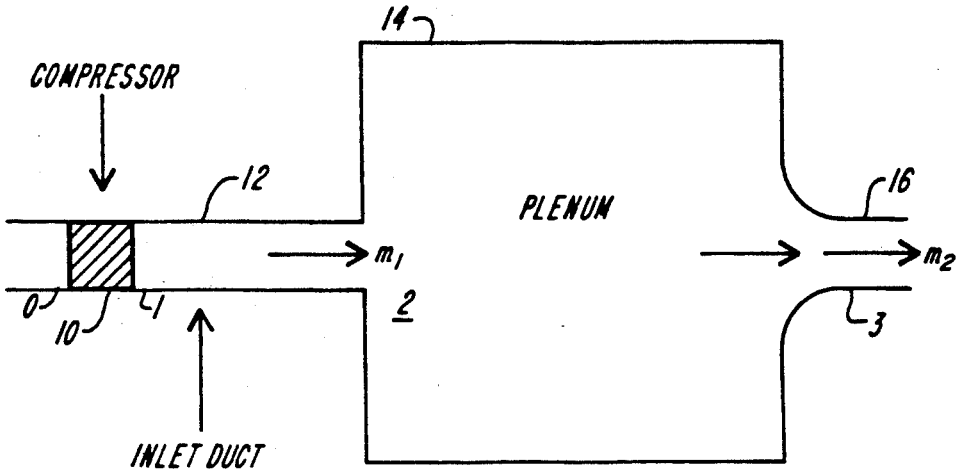
FIG. 1 is a schematic illustration of a basic compression system.

The dynamic stability of a pumping system can be modeled using a one-dimensional lumped parameter model. The model has four basic components. The compressor, modeled as an actuator disc, can be viewed as a system damper (positive or negative depending on the slope of the compressor pressure rise versus mass flow characteristics). The system inertial properties are lumped into the fluid in the inlet duct. The plenum provides the system compliance and the throttle can be viewed as another system damper. A schematic diagram of such a pumping system is shown in FIG. 1. A compressor section 10 is connected by an inlet duct 12 to a plenum 14. The plenum 14 in turn is connected to a throttle 16 The basic equations for flow through each component of the system with reference to station locations are:

| Station | | |
|---|---|---|
| (0-1) | Compressor (pumping characteristic) | $P_{ATM} + \Delta P_c(\dot{m}\ 1) = P_1$ |
| (1-2) | Inlet Duct (1-D mom. eq.) | $(P_1 - P_2)A_c = \partial/\partial t\ (\rho A_c L_c C_x)$ |
| (2) | Plenum (continuity) | $\dot{m}_1 - \dot{m}_2 = \partial/\partial t\ (\rho_2 V_2)$ |
| (2-3) | Throttle (pressure drop characteristic) | $P_2 - \Delta P_T(m_2) = P_{ATM}$ |

The nomenclature used in this specification is set forth in the appendix.

Applying small perturbation theory, linearizing, and non dimensionalizing results in the standard eigenvalue problem given below:

$$\begin{bmatrix} B\dfrac{\partial \Delta P_c}{\partial \phi} - S & \dfrac{-\rho_0}{\rho_T}\dfrac{B\phi_2}{A_2^2} \\ \dfrac{\rho_T}{\rho_0}\dfrac{A_2^2}{B\phi_2} & \dfrac{-\rho_T}{\rho_0}\dfrac{A_2^2}{B\phi_2} - S \end{bmatrix} \begin{Bmatrix} \delta\phi_1 \\ \delta\phi_2 \end{Bmatrix} = 0$$

The dynamic stability of the uncontrolled pumping system is mainly dependent on the compression system stability parameter B and the slope of the compressor characteristic. For stability, the energy dissipated in the throttle 16 due to a small disturbance must be greater than the energy added to the flow by the compressor 10. An energy balance analysis shows that the effect of increasing the B parameter or increasing the slope of the compressor characteristic is to reduce the ratio of the energy dissipated by the throttle to the energy generated by the compressor for a given mass flow oscillation.

Since the slope of the compressor characteristic is a property of the machine and the B parameter is often constrained by other requirements, a successful control strategy would need either to increase the energy dissipated in the throttle or to provide an alternative method to damp the flow oscillations.

Figure 2:
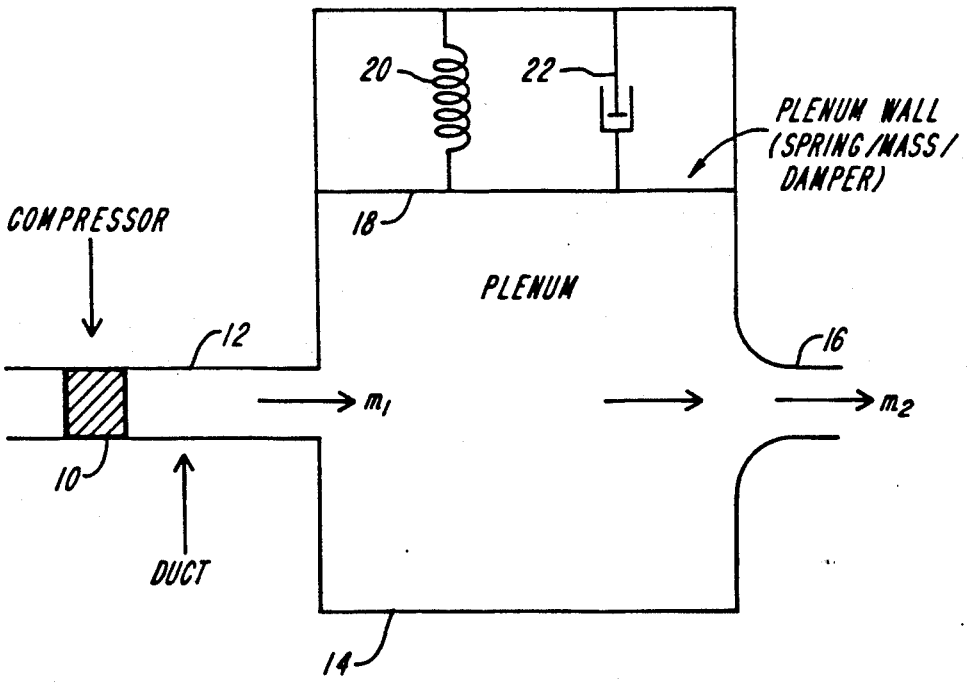
FIG. 2 is a schematic illustration of a compression system with a passively controlled movable plenum wall.

Several methods of stabilization are disclosed in this specification. Each method involves coupling the basic pumping system to an additional fluid dynamic or structural dynamic mechanism to dissipate energy. The flexible plenum wall technique for dissipating energy is shown in FIG. 2. According to this technique, the basic pumping system is modified to include a flexible plenum wall 18. The flexible or movable plenum wall 18 is modeled as a mass-spring-damper system, and responds to pressure perturbations in the plenum 14. In this model, one may consider that the movable plenum wall 18 is connected to passive elements such as a spring 20 and a damper or dashpot 22. This aeroelastic coupling allows the damper 22 attached to the movable wall 18 to extract and dissipate energy from the unsteady fluid dynamic flow oscillations in the plenum 14. Those skilled in the art will appreciate that the spring and damper elements need not be separate; the arrangement in FIG. 2 is merely exemplary.

Including the aeroelastic coupling and the plenum wall dynamics with the basic pumping system yields the following eigenvalue problem.

$$\begin{bmatrix} B\dfrac{\partial \Delta P_c}{\partial \phi} - S & \dfrac{-\rho_0}{\rho_T}\dfrac{B\phi_2}{A_2^2} & 0 & 0 \\ \dfrac{\rho_T}{\rho_0}\dfrac{A_2^2}{B\phi_2} & \dfrac{-\rho_T}{\rho_0}\dfrac{A_2^2}{B\phi_2} - S & 0 & \dfrac{-\rho_p}{\rho_0}\dfrac{\rho_T}{\rho_0}\dfrac{1}{MN^2}\dfrac{A_2^2}{\phi_2} \\ 0 & 0 & -S & 1 \\ 0 & \dfrac{\rho_0}{\rho_T} WAP2_0 B^2 \dfrac{\phi_2}{A_2^2} & \dfrac{-\rho_1}{\rho_0} Qp_0^2 & 2\xi p_0 Qp_0 \dfrac{\rho_1}{\rho_0}\dfrac{\rho_0}{\rho_1} - S \end{bmatrix} \begin{Bmatrix} \delta\phi_1 \\ \delta\phi_2 \\ \delta V \\ \delta\eta \end{Bmatrix} = 0$$

The resulting non-dimensional control parameters $WAP2_0$, $Qp_0$, $\xi p_0$, determine the effectiveness of the control scheme. As will be appreciated by those skilled in the art, these control parameters are directly related to the movable wall mass, the spring rate of the restoring spring, and the damping ratio provided by the dampers. To achieve a surge suppression, the plenum wall 18 must be properly "tuned", because a mistuned plenum can actually be destabilizing. An eigenvalue analysis of the eigenvalue problem set out above produces a set of control parameters which stabilize the model system to zero mass flow at a B parameter of 1.0.

Figure 3:
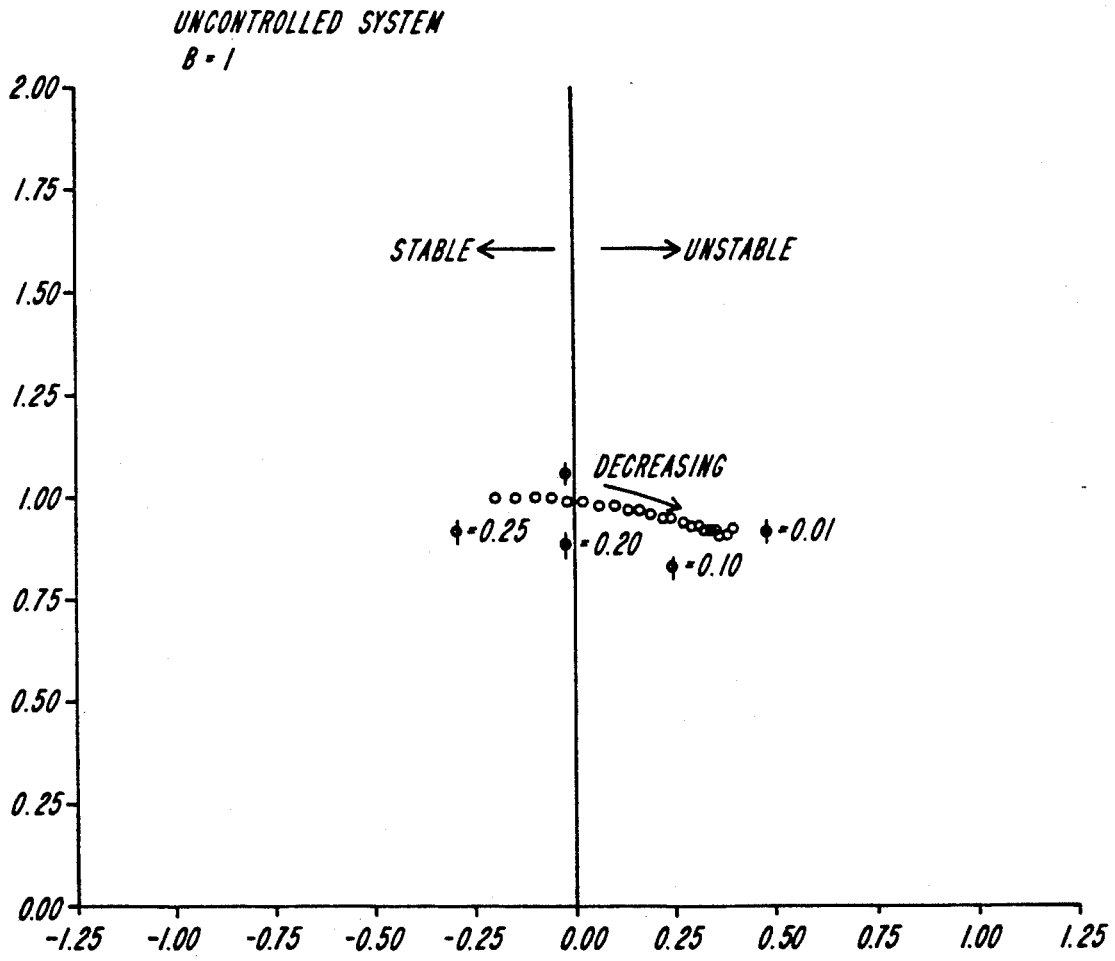
FIG. 3 is a root locus plot of an uncontrolled basic pumping system.
Figure 4:
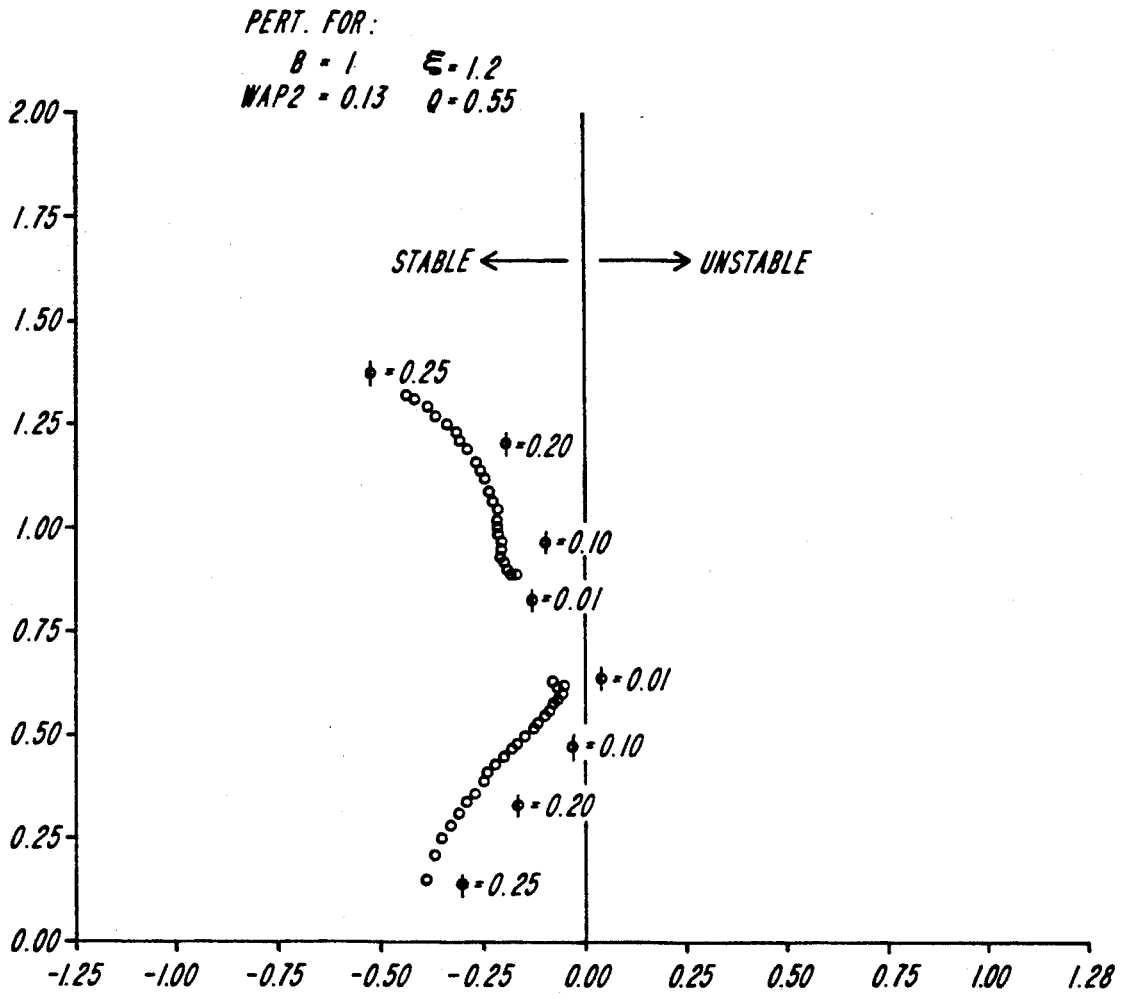
FIG. 4 is a root locus plot of a pumping system with the flexible plenum wall apparatus.

Energy balance analysis demonstrates that the plenum wall is the dominant energy dissipator at low mass flow. A root locus plot of the system of FIG. 1 which does not include a movable plenum wall as a function of mass flow coefficient $\phi$ is shown in FIG. 3. Note that as the mass flow coefficient $\phi$ decreases, the poles of the eigenvalue problem migrate into the right half plane indicating system instability. FIG. 4 is a root locus plot for the eigenvalue problem characterizing the flexible plenum wall pumping system. The increased stability of the modified system is evident in that the poles remain in the left half plane. The values of the non-dimensional control parameters are set forth in FIG. 4.

Figure 5:
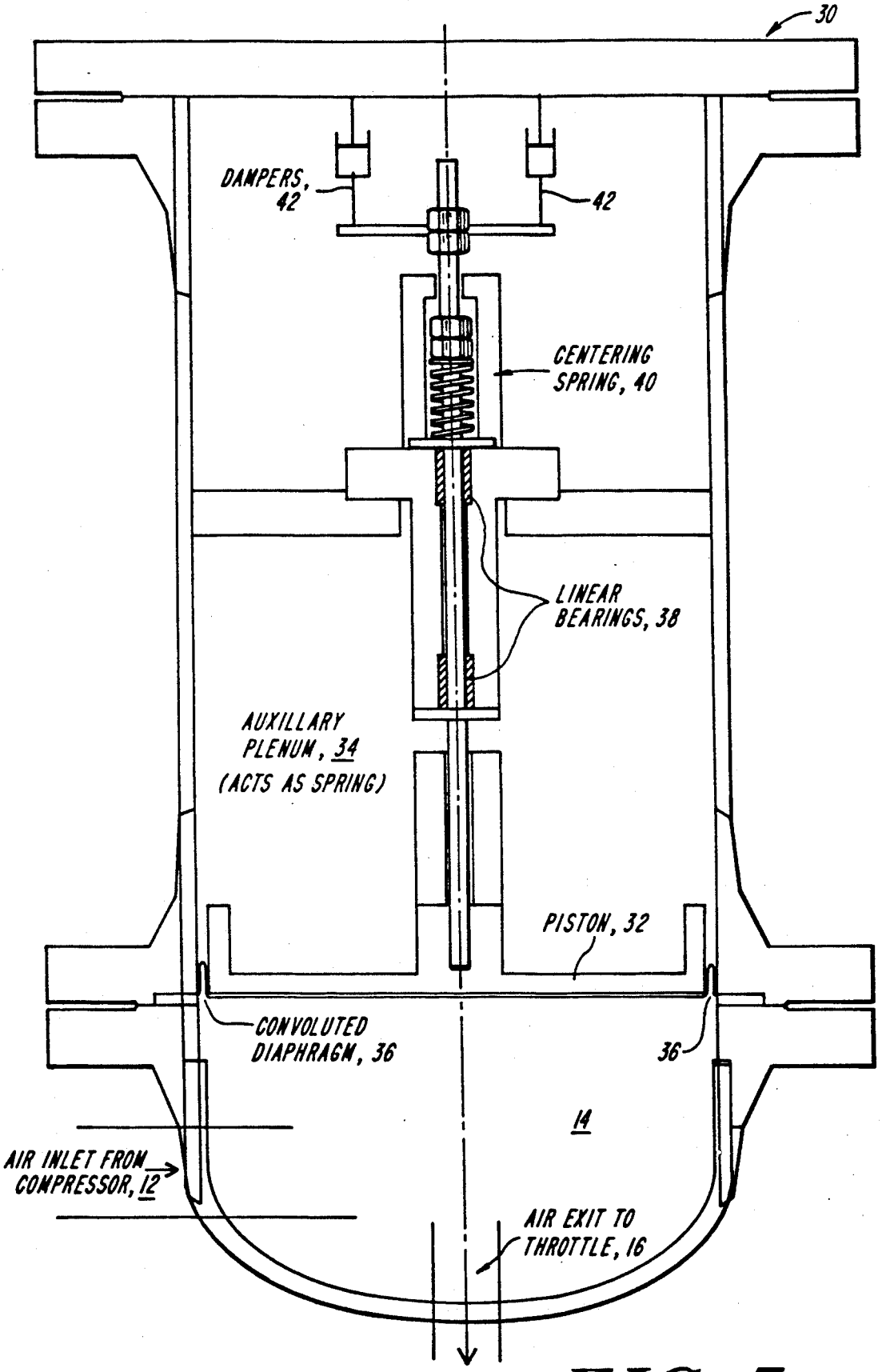
FIG. 5 is a cross sectional view of an experimental rig embodying the present invention.

The flexible plenum wall technique discussed above has been experimentally verified. An experimental test rig is shown in FIG. 5. The mechanical design of the test rig 30 was based on matching the non-dimensional control parameters for which control was predicted, minimizing non-linearities in the design and developing a physically realistic design. One of the major constraints on the flexible plenum wall was that it was required to withstand the large steady state and surge pressure loading, yet still respond linearly to small amplitude pressure perturbations. These two requirements made a mechanical spring implementation difficult A flexible membrane was investigated; however, difficulties were predicted in engineering the survivability of the membrane during surge and properly damping the motion of the membrane. A rigid piston and aerodynamic spring were found to be simple, practical solutions to these constraints, well suited to an initial demonstration of the concept. The test rig 30 includes a rigid piston 32 which defines a second or auxiliary plenum 34. The piston 32 is sealed by a low friction, convoluted diaphragm 36 and is supported by linear ball bearings 38. Air enclosed in the second plenum 34, pressurized to the steady state plenum 14 pressure, yet isolated from unsteady perturbations, balances the steady state load while providing a guasi-linear restoring force. A mechanical centering spring 40 is used to offset the weight of the piston and to set the eguilibrium position of the piston, independent of operating point.

The linear model of the pumping system assumes the absence of friction and the low friction convoluted diaphragm 36 and linear ball bearings 38 provide a relatively low level of friction. Further, the non-dimensional control parameters require that the plenum wall be heavily damped. Since minimizing the non-linear friction forces acting on the piston was important, air dashpots were considered. Due to the compressibility effects, however, the air dashpots had an unsatisfactory frequency response. Commercially available dashpots exhibited unacceptable breakaway friction loads. To meet the low friction, high frequency response requirements, a hydraulic actuator was modified by connecting the ports to an adjustable throttling valve. The motion of the actuator piston forces fluid through the valve thereby yielding an adjustable guasi-viscous dashpot 42.

Figure 6:
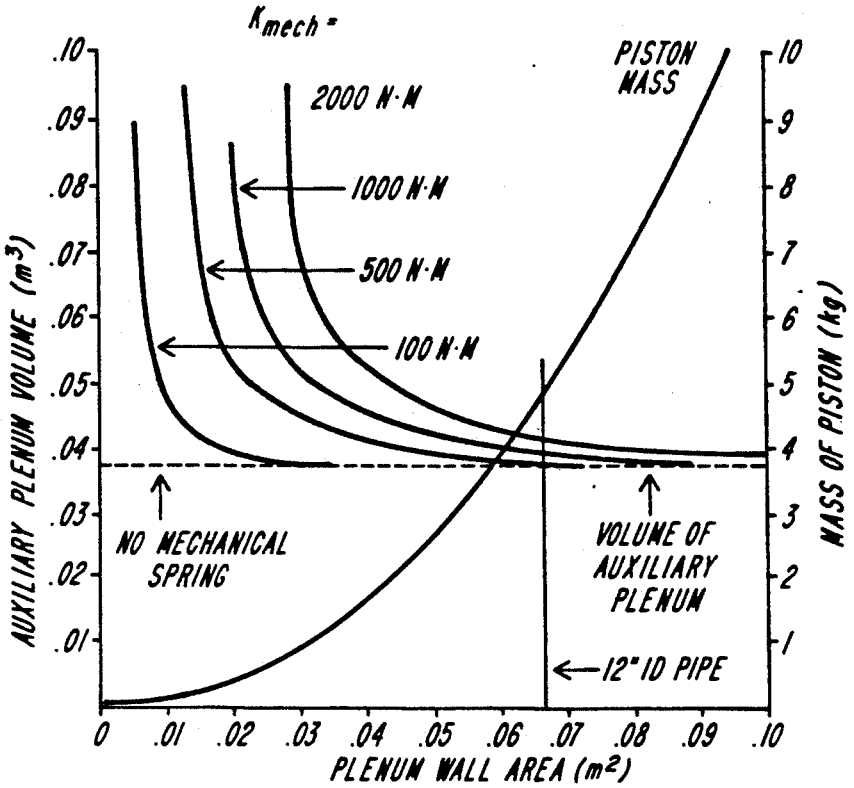
FIG. 6 is a plot of design curves for auxiliary plenum volume, piston mass and area.

The physical dimensions of the passive control rig were determined by selecting the actual compressor and desired operating conditions and matching the non-dimensional control parameters. The goal was to design a rig with commercially available parts. FIG. 6 shows the required mass of the piston 32 and volume of the auxiliary plenum 34 as a function of piston area for several mechanical spring constants. Piston mass is chosen based on the following considerations A large piston mass implies that large dynamic impact loads would occur during surge; a small piston mass implies an increase in the importance of friction forces and increases the required volume of the auxiliary plenum. To aid in assessing the design tradeoffs and the effect of nonlinearities, a nonlinear, time marching, numerical integration of equations of motion was developed. Such a numerical integration is well known to those skilled in the art. A piston area corresponding to a twelve-inch I.D schedule 40 pipe was shown to be an adequate design compromise for an initial demonstration of the invention. The physical dimensions and typical operating conditions of the rig 30 and the corresponding non-dimensional parameters are listed in Table 1 below.

TABLE 1

PHYSICAL DIMENSIONS AND OPERATING CONDITIONS OF FLEXIBLE PLENUM WALL DEMONSTRATOR RIG

| |
|---|
| WAP20 = 0.13 |
| $\xi P_0 = 1.2$ |
| $QP_0 = 0.55$ |
| Area of Plenum Wall = 0.067 $M^2$ |
| Mass of Plenum Wall = 5.23 kg |
| Volume of Plenum = 0.0108 $m^3$ |
| Volume of Auxiliary Plenum = 0.0388 $m^3$ |
| Spring Constant = 21000 n/m |
| Mechanical Spring Constant = 2100 n/m |
| Damping Constant = 740 n's/m |
| Inlet Duct Length = 1.16 m |
| Inlet Area = 0.00125 $m^2$ |
| Typical Operating Conditions: |
| B = 1.0 |
| U = 130.8 m/s |
| $\omega_H$ = 110 rad/sec |
| Temperature = 320° K. |
| Plenum Pressure = 118000 $n/m^2$ |
| Plenum Density = 1.28 $kg/m^3$ |

Figure 7:
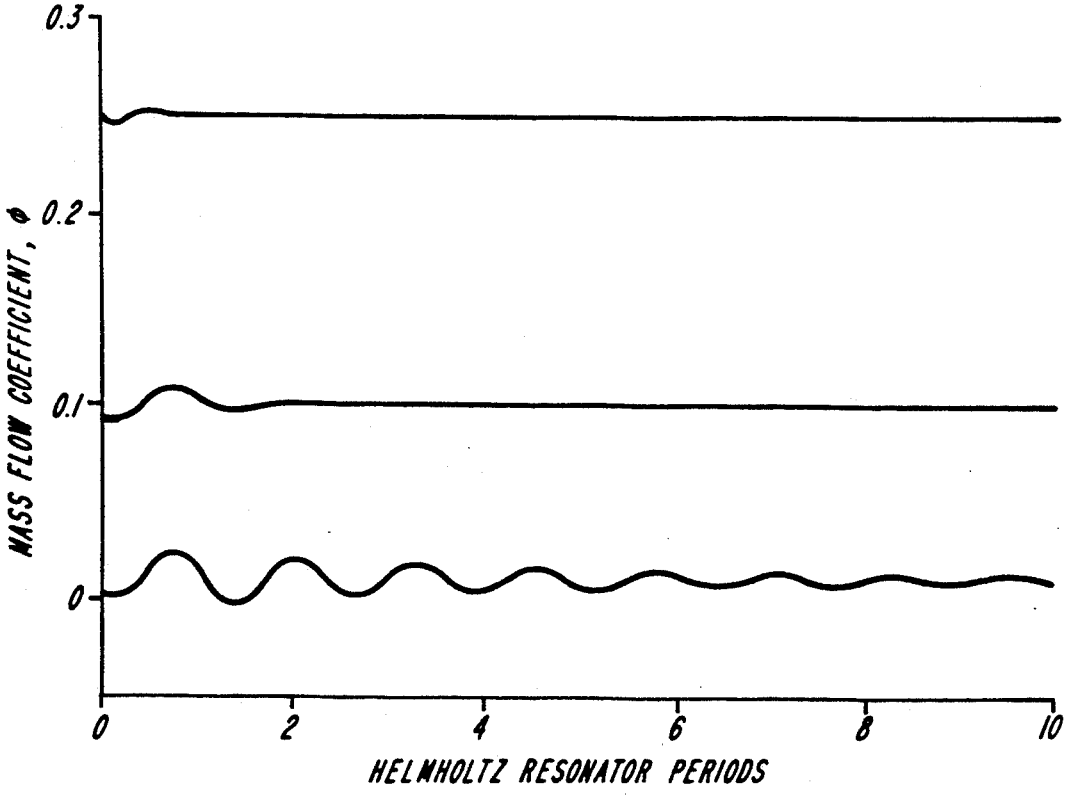
FIG. 7 is a plot of mass flow time response to a 20% ambient pressure disturbance at three flow coefficients for the embodiment of FIG. 5.

The non-linear analysis predicted stability boundaries consistent with the linear analysis for a 20% inlet pressure disturbance. The time history response of the system's inlet mass flow at three different flow coefficients is shown in FIG. 7. The non-linear analysis also allowed quantitative predictions of both surge and impact loads as well as the effects of friction and displacement limiters.

Figure 8:
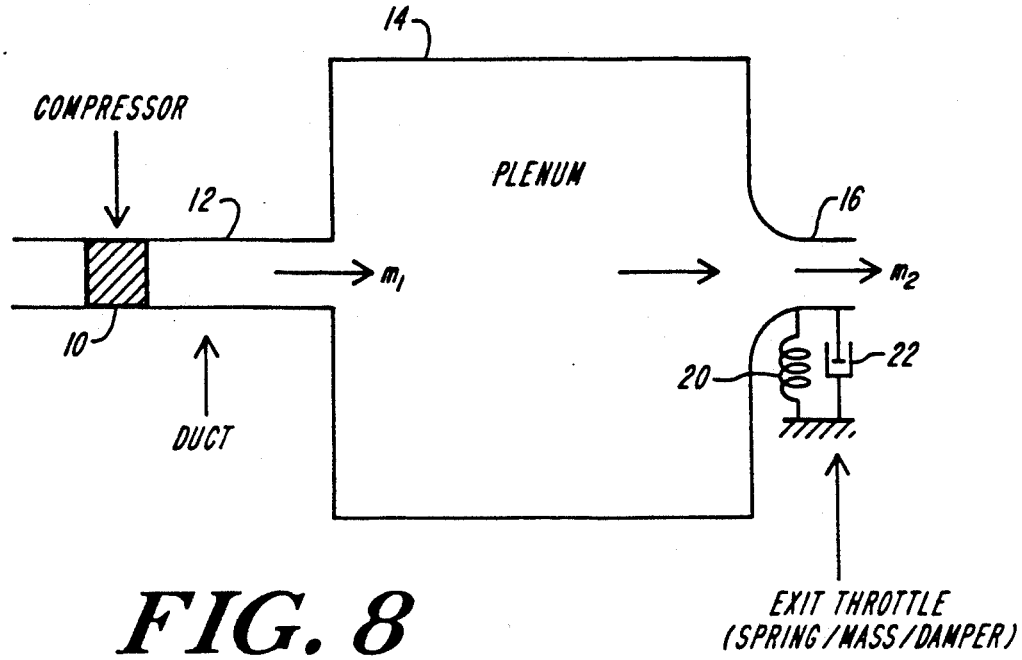
FIG. 8 is a schematic illustration of a compression system with passive throttle control.
Figure 9:
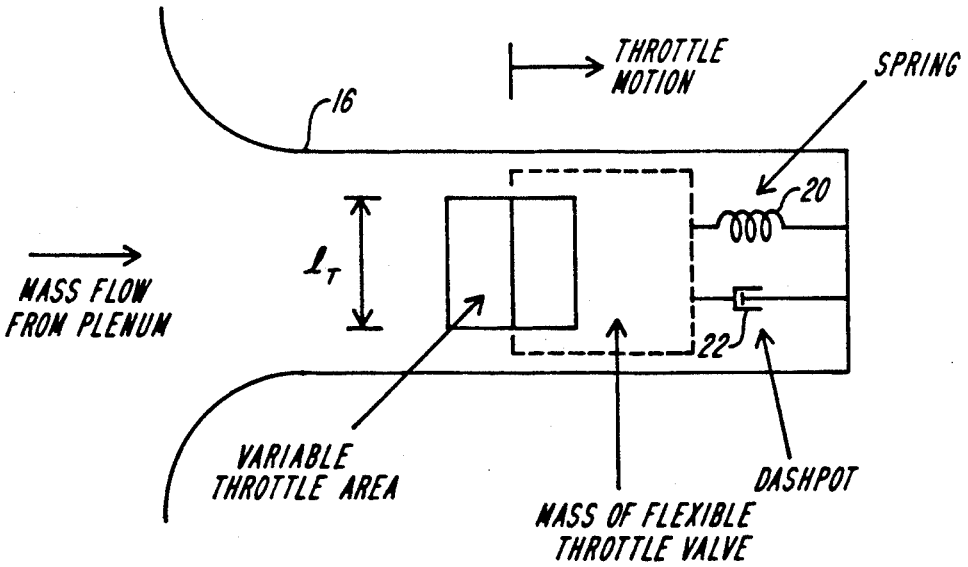
FIG. 9 is a schematic illustration of a flexible throttle mechanism.

Another control strategy of the invention involves modifying the main throttle valve. Throttle motion has previously been demonstrated to be effective in surge suppression when used with active control. See, the above noted AIAA 10th Aeroacoustics Conference paper. In the passive control scheme disclosed here, the throttle valve is modeled as a mass-spring-damper system which responds to unsteady pressure perturbation within the plenum. A schematic of this technique is shown in FIG. 8. A more detailed view of the throttle valve itself is shown in FIG. 9. In the embodiment illustrated in FIGS. 8 and 9, the throttle 16 has a variable throat area. In the embodiment in FIG. 9, throttle motion, constrained by the spring 20 and the damper 22 varies throttle area. In this flexible throttle method, the damper is present mainly to affect the dynamic behavior of the throttle valve rather than as an energy dissipator. The main increase in energy dissipation is a result of modifying the instantaneous throttle valve pressure versus mass flow characteristic. The equations of motion for this modified pumping system shown in standard eigenvalue form are:

$$\begin{bmatrix} B\frac{\partial \Delta P_c}{\partial \phi} - S & \frac{-\rho_0}{\rho_T}\frac{B\phi_2}{A_2^2} & \frac{\rho_0}{\rho_T}\frac{B\phi_2^2}{A_2^3} & 0 & 0 \\ \frac{\rho_T}{\rho_0}\frac{A_2^2}{B\phi_2} & \frac{-\rho_T}{\rho_0}\frac{A_2^2}{B\phi_2} - S & 0 & & \frac{\phi_2}{A_2} \\ 0 & 0 & -S & & 1 \\ 0 & \frac{\rho_0}{\rho_T} TB^2\frac{\phi_2}{A_2^2} & \frac{-\rho_0}{\rho_T} TB^2\frac{\phi_2^2}{A_2^3} - Q^2 & & -2\xi Q - S \end{bmatrix} \begin{Bmatrix} \delta\phi_1 \\ \delta\phi_2 \\ \delta A_2 \\ \delta\beta \end{Bmatrix} = 0$$

Figure 10:
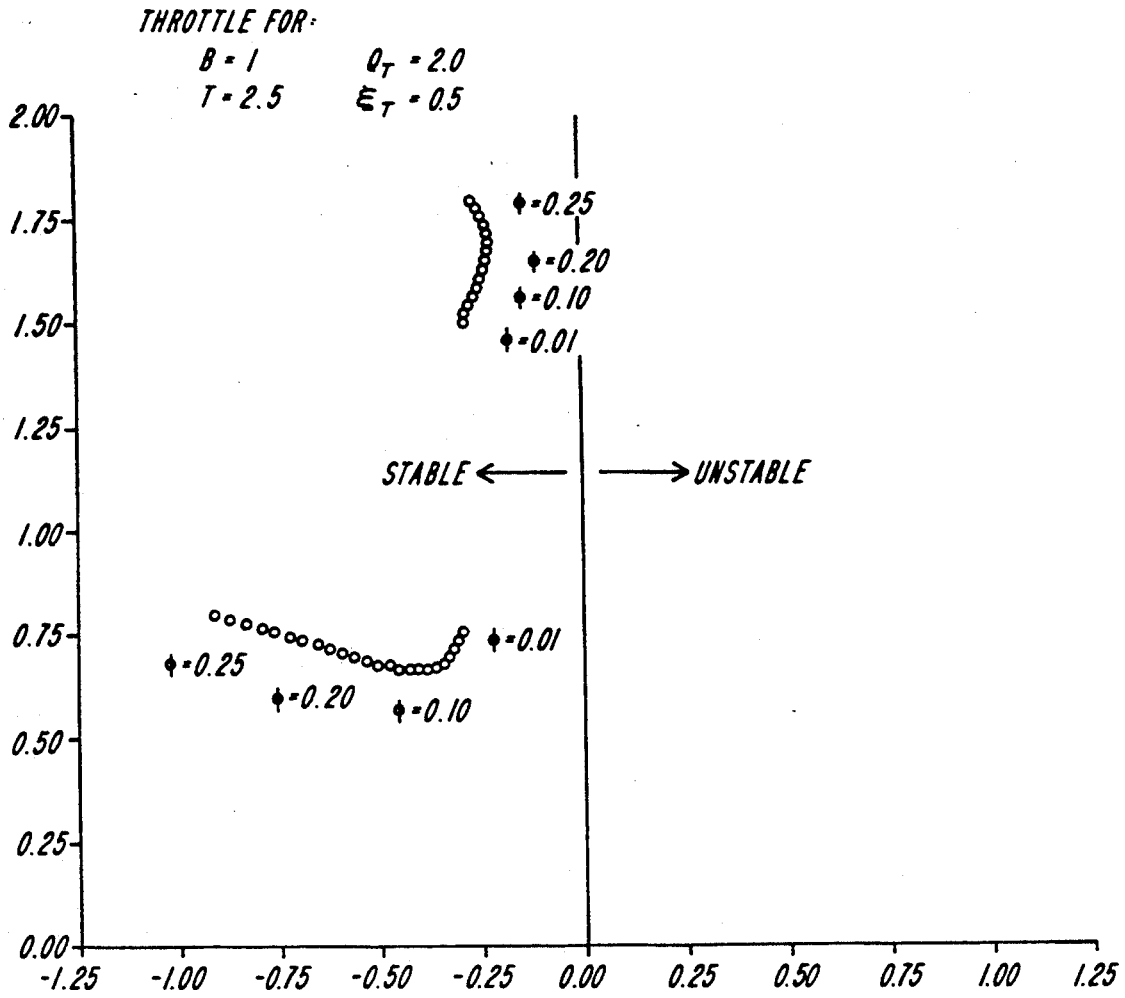
FIG. 10 is a root locus plot of a pumping system with the flexible throttle apparatus.

Again, the analysis produced three non-dimensional control parameters: T, $\xi_T$ and $Q_T$. The stability of the pumping system is dependent on these control parameters. For a properly tuned flexible throttle, stable flow can exist near zero flow for B=1.0 as shown by the root locus in FIG. 10. The values of the control parameters are also shown in FIG. 10. Note that the eigenvalues are in the left half plane indicating stability.

Figure 11:
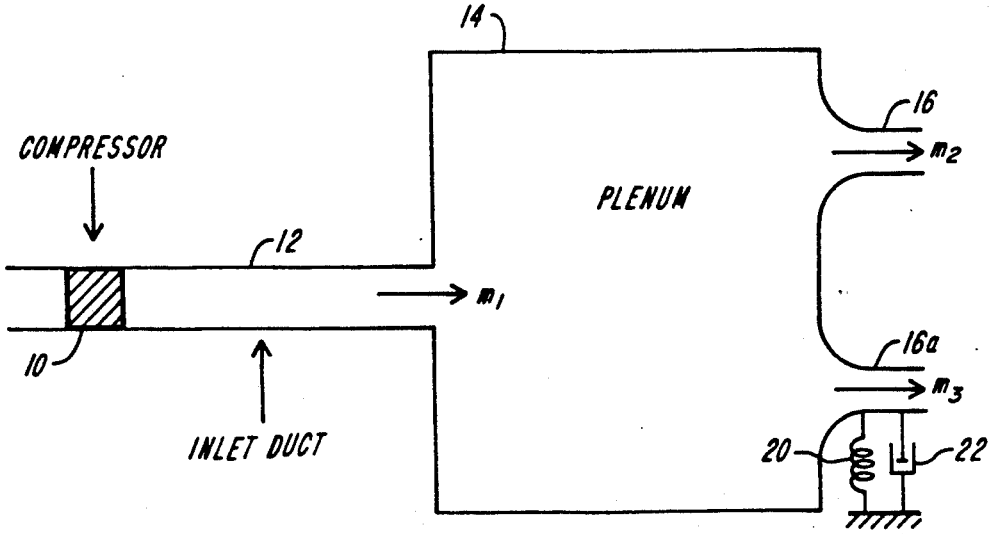
FIG. 11 is a schematic illustration of an auxiliary throttle apparatus.

Yet another embodiment of the invention is shown in FIG. 11. The control strategy of the embodiment of FIG. 11 is related to the approach involving the flexible throttle discussed in conjunction with FIGS. 8 and 9. In this embodiment, a small, auxiliary flexible throttle 16a is provided in parallel with the main steady state throttle 16. As in the embodiments of FIGS. 8 and 9, the throttle 16a has a movable portion affixed to passive elements such as a spring 20 and a dashpot 22. This embodiment has the advantage that the main steady state throttle need not be modified.

The eigenvalue problem that results from the auxiliary throttle embodiment of FIG. 11 is:

$$\begin{bmatrix} B\frac{\partial\Delta\tilde{P}_c}{\partial\phi}-S & \frac{-\rho_0}{\rho_{T2}}B\frac{\phi_2}{A_{T2}^2} & 0 & 0 \\ \frac{\rho_{T2}}{\rho_0}\frac{\tilde{A}_{T2}^2}{B\phi_2} & \frac{-\rho_{T2}}{\rho_0}\frac{\tilde{A}_{T2}^2}{B\phi_2}-S & \frac{\rho_{T2}}{\rho_0}\frac{\tilde{A}_{T2}^2}{B\phi_2} & 0 \\ 0 & \frac{B}{\alpha}\frac{\rho_0}{\rho_{T2}}\frac{\phi_2}{A_{T2}^2} & \frac{-B}{\alpha}\frac{\rho_0}{\rho_{T3}}\frac{\phi_3}{A_{T3}^2}-S & \frac{-B}{\alpha}\frac{\rho_0}{\rho_{T4}}\frac{\phi_4}{A_{T4}^2} \\ 0 & 0 & \frac{1}{\sigma B}\frac{\rho_{T4}}{\rho_0}\frac{\tilde{A}_{T2}^2}{\phi_4} & \frac{-1}{\sigma B}\frac{\rho_{T4}}{\rho_0}\frac{\tilde{A}_{T4}^2}{\phi_4}-S \end{bmatrix}\begin{Bmatrix}\delta\phi_1\\ \delta\phi_2\\ \delta\phi_3\\ \delta\phi_4\end{Bmatrix}=0$$

Figure 12:
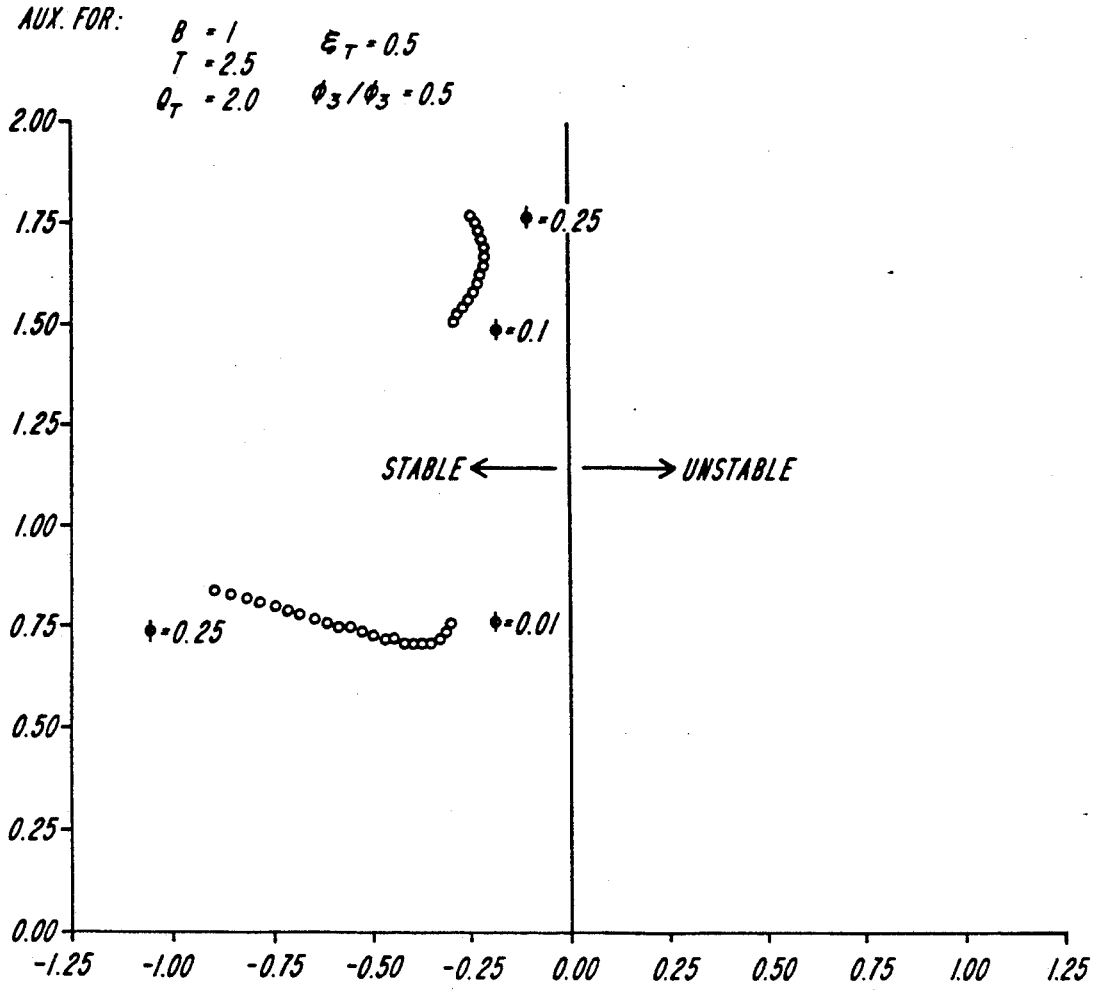
FIG. 12 is a root locus plot of a pumping system with the auxiliary throttle apparatus.

The control parameters are similar to the flexible throttle method parameters discussed above, except for one additional parameter—the mass flow ratio between the two throttles 16 and 16a. However, analysis shows that the linear stability of the system is independent of this quantity. The mass flow ratio is important, however, when assessing non-linear effects such as finite amplitude disturbances. The equations of motion for this embodiment agree with the equations of motion for the embodiment of FIGS. 8 and 9 in the limit as $\phi_2 \rightarrow 0$($\phi_2$ is the mass flow coefficient through the steady state throttle). The root locus plot in FIG. 12 demonstrates the effect of a properly tuned auxiliary throttle on system stability.

Figure 13:
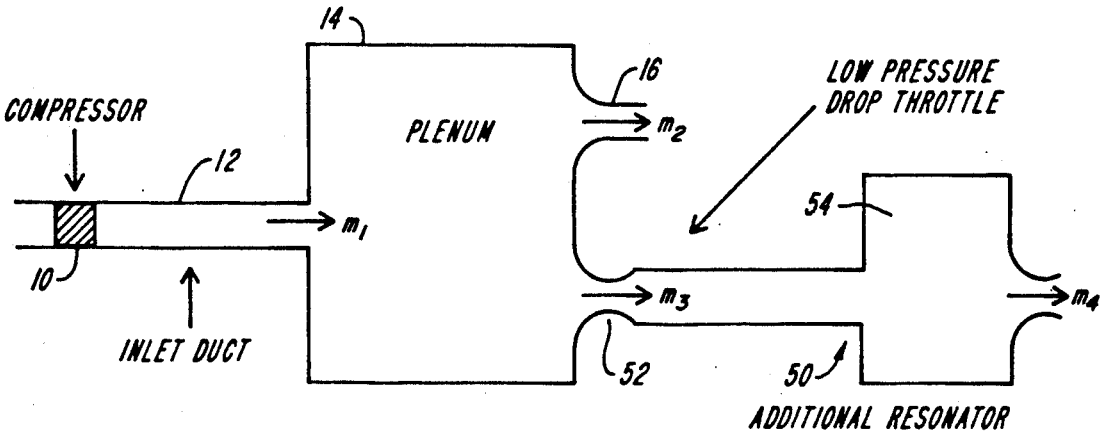
FIG. 13 is a schematic illustration of an aerodynamic damper apparatus.

Yet another embodiment of the present invention is shown in FIG. 13 The reduction in the unsteady energy dissipated by the throttle at large B parameters can partly be attributed to the steepness of the throttle characteristic. Additional control can therefore be accomplished if the unsteady (or "effective") throttle slope can be reduced. To accomplish this throttle slope reduction, a second Helmholtz resonator system 50 is added in series to the original pumping system. The two systems are connected by a low pressure loss throttle 52. When properly tuned, pressure oscillations in the main plenum 14 are damped by mass flow oscillations between the main plenum 14 and an additional plenum 54 through the low pressure drop throttle 52.

There are strong analogies between the flexible plenum wall embodiment discussed above and the acoustic throttle of FIG. 13. Each one is essentially a tuned mass-spring-damper system coupled to the original system to achieve control. The aerodynamic damper of FIG. 13 is the fluid dynamic version of the flexible plenum wall.

The equations of motion for the aerodynamic damper are:

$$\begin{bmatrix} B\frac{\partial\Delta\tilde{P}_c}{\partial\phi}-S & \frac{-\rho_0}{\rho_{T2}}B\frac{\phi_2}{A_{T2}^2} & 0 & 0 \\ \frac{\rho_{T2}}{\rho_0}\frac{\tilde{A}_{T2}^2}{B\phi_2} & \frac{-\rho_{T2}}{\rho_0}\frac{\tilde{A}_{T2}^2}{B\phi_2}-S & \frac{\rho_{T2}}{\rho_0}\frac{\tilde{A}_{T2}^2}{B\phi_2} & 0 \\ 0 & \frac{B}{\alpha}\frac{\rho_0}{\rho_{T2}}\frac{\phi_2}{A_{T2}^2} & \frac{-B}{\alpha}\frac{\rho_0}{\rho_{T3}}\frac{\phi_3}{A_{T3}^2}-S & \frac{-B}{\alpha}\frac{\rho_0}{\rho_{T4}}\frac{\phi_4}{A_{T4}^2} \\ 0 & 0 & \frac{1}{\sigma B}\frac{\rho_{T4}}{\rho_0}\frac{\tilde{A}_{T2}^2}{\phi_4} & \frac{-1}{\sigma B}\frac{\rho_{T4}}{\rho_0}\frac{\tilde{A}_{T4}^2}{\phi_4}-S \end{bmatrix}\begin{Bmatrix}\delta\phi_1\\ \delta\phi_2\\ \delta\phi_3\\ \delta\phi_4\end{Bmatrix}=0$$

Figure 14:
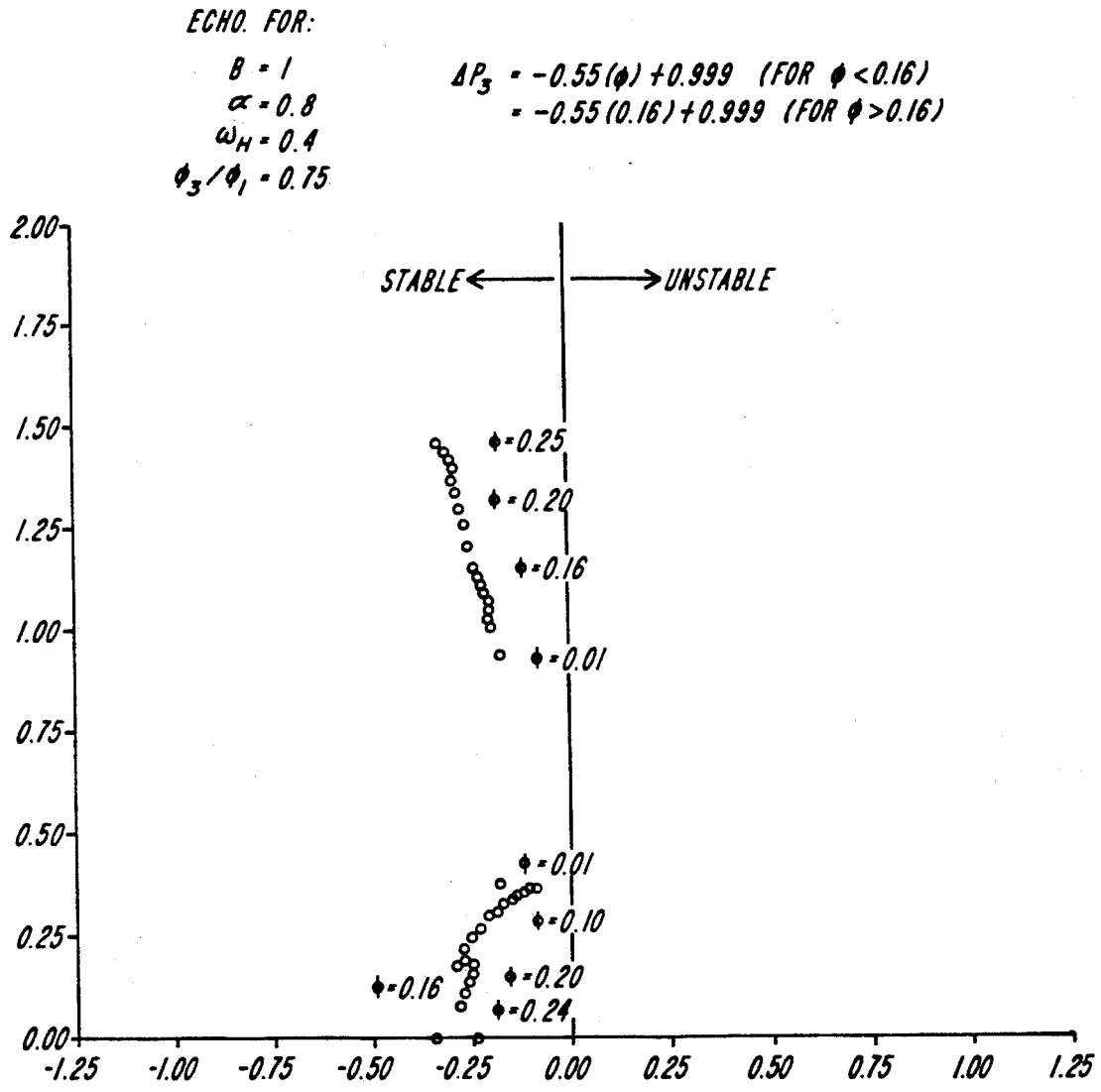
FIG. 14 is a root locus plot of a pumping system with the aerodynamic damper apparatus.

Again, the effectiveness of this system is determined by the non-dimensional control parameters ($\phi_3/\phi_2$, $\omega_{H4}\omega_H$, $\alpha$, $\Delta\tilde{P}_3$). The root locus plot for a properly tuned throttle is shown in FIG. 14 where, again, stabilization to near zero flow is predicted. The values of the control parameters are also given in FIG. 14.

APPENDIX $$\begin{bmatrix} B\frac{\partial\Delta P_c}{\partial\phi}-S & \frac{-\rho_0}{\rho_T}B\frac{\phi_{TOT}}{A_{TOT}}\frac{1}{A_2} & 0 & 0 \\ \frac{1}{B}\frac{\rho_T}{\rho_0}\frac{A_{TOT}}{\phi_{TOT}}A_2 & -\frac{1}{B}\frac{\rho_T}{\rho_0}\frac{A_T^2}{\phi_{TOT}}-S & \frac{-\rho_T}{\rho_0}\frac{A_2}{B} & 0 \\ 0 & 0 & -S & 1 \\ 0 & \frac{\rho_0}{\rho_T}T_{AUX}B^2\frac{\phi_{TOT}}{A_{TOT}}\frac{1}{A_2} & -Q^2 & -2\xi Q-S \end{bmatrix}\begin{Bmatrix}\delta\phi_1\\ \delta\phi_2\\ \delta A_3\\ \delta\eta\end{Bmatrix}=0$$

Nomenclature $$B=\frac{U}{\omega_H L_c}=\text{compression system stability parameter}$$

$$\frac{\partial\Delta\tilde{P}}{\partial\phi}=\frac{\partial(\Delta P/\rho_0 U^2)}{\partial(m/\rho_0 A_{in}U)}=\text{slope of non-dimensional compressor characteristic}$$

S=complex eigenvalue $\rho$=density $\phi=\dot{m}/\rho_0 A_{in}U$=mass flow coefficient A=Area $A=A/A_{in}$=non-dimensional area $WAP2_0=\rho_0 A_p^2 L_c^2/M_p V_p$=plenum forcing effectiveness parameter $Q=\omega_0/\omega_H$=non-dimensional natural frequency $\xi=C/2M\omega_0$=damping ratio $T=\rho_0(A_v/A_{in})(L_c^2/M_T)(2l_T)$= throttle forcing effectiveness parameter $\beta$=non-dimensional rate of change of throttle area $\eta$=non-dimensional rate of change of plenum volume $\alpha=L_A/L_c$=ratio of additional resonator's inlet duct length to the basic system's inlet duct $\sigma=V_A/V_p$=ratio of additional resonator's plenum volume to the basic system's plenum volume $$\omega_H = a\sqrt{A_{in}/L_c V_p} = \text{Helmholtz resonator frequency}$$

L=inlet duct length l=length scale for active throttle V=volume U=tip speed of compressor M=mass m=mass flow C=damping constant $\tilde{P}=p-p/\rho_0 U^2$=non-dimensional pressure rise $\delta$=perturbation quantity $\tau=t\cdot\omega_H$=non-dimensional time Subscripts C=compressor 1,2,3,4=indicates position as listed in schematics T=throttle p=plenum O=ambient TOT=total steady state value in=inlet V=Pressure loaded area of flexible throttle

We claim:

1. Compressor surge control apparatus for a compressible fluid comprising:

a compressor connected to a plenum including a moveable wall whose motion varies the volume of the plenum, the wall connected to passive elements forming a spring-mass-damper system selected to damp pressure fluctuations in the plenum wherein the moveable wall is a rigid piston sealed with a convoluted diaphragm.

2. Compressor surge control apparatus for a compressible fluid comprising:

a compressor connected to a plenum including a moveable wall whose motion varies the volume of the plenum, the wall connected to passive elements forming a spring-mass-damper system selected to damp pressure fluctuations in the plenum wherein the damper is a hydraulic damper.

* * * * *

UNITED STATES PATENT AND TRADEMARK OFFICE

CERTIFICATE OF CORRECTION

PATENT NO. : 5,199,856

DATED : April 6, 1993

INVENTOR(S) : Alan H. Epstein, Edward M. Greitzer, Daniel L. Gysling, John Dugundji and Gerald R. Guenette It is certified that error appears in the above-indentified patent and that said Letters Patent is hereby corrected as shown below:

Column 1, line 67: delete "guasi-viscous" and insert therefor -- quasi-viscous --;

Column 5, line 19: delete "guasi-linear" and insert therefor -- quasi-linear --;

Column 5, line 21: delete "eguilibrium" and insert therefor -- equilibrium --;

Column 5, line 38: delete "guasi-viscous" and insert therefor -- quasi-viscous --;

Column 8, line 58: delete "$A=A/A_{in}$" and insert therefor -- $\tilde{A}=A/A_{in}$ --;

Column 8, line 62: delete "$(2l_T)$" and insert therefor -- $(2\ell_T)$; and

Column 9, line 6: delete "$l$=length" and insert therefor -- $\ell$=length --.

Signed and Sealed this

Nineteenth Day of April, 1994

Bruce Lehman

*Attest:*

BRUCE LEHMAN

*Attesting Officer*

*Commissioner of Patents and Trademarks*